US006902392B2

(12) United States Patent
Johnson

(10) Patent No.: US 6,902,392 B2
(45) Date of Patent: Jun. 7, 2005

(54) INTERFERENCE-FREE CAM FOR HINGED-LID LIGHTERS

(75) Inventor: Michael Wayne Johnson, Port Allegany, PA (US)

(73) Assignee: Zippo Manufacturing Company, Bradford, PA (US)

( * ) Notice: Subject to any disclaimer, the term of this patent is extended or adjusted under 35 U.S.C. 154(b) by 0 days.

(21) Appl. No.: 10/787,433

(22) Filed: Feb. 26, 2004

(65) Prior Publication Data

US 2004/0209211 A1 Oct. 21, 2004

Related U.S. Application Data

(60) Provisional application No. 60/450,270, filed on Feb. 27, 2003.

(51) Int. Cl.[7] ..... F23Q 2/00

(52) U.S. Cl. ..... 431/142; 431/151; 431/152; 431/154; 431/277; 431/344

(58) Field of Search ..... 431/142, 151, 431/152, 154, 277, 344

(56) References Cited

U.S. PATENT DOCUMENTS 2,774,234 A * 12/1956 Blaisdell et al. ..... 431/277
2,803,123 A * 8/1957 Owen ..... 431/152
4,403,945 A * 9/1983 Leitgib ..... 431/150
6,247,920 B1 6/2001 Pfeil
6,659,763 B2 * 12/2003 Fisher ..... 431/131

FOREIGN PATENT DOCUMENTS

DE 956 275 1/1957
JP 360175923 * 9/1985 ..... F23Q/2/28

* cited by examiner

*Primary Examiner*—Stephen Gravini
(74) *Attorney, Agent, or Firm*—Faegre & Benson LLP

(57) ABSTRACT

A lighter comprising an outer case having a first sidewall disposed in spaced apart relation to a second sidewall, a first end wall disposed in spaced apart relation to a second end wall, and a base connected to the side walls and end walls. A lid having lid end walls and lid side walls connected to a cover. A curved hinge connecting the outer case and lid. An inside unit is provided and is receivable in the outer case. The inside unit has a plate and front and rear lugs. A cam is mounted to the rear lugs and slides over the curved hinge. The cam has a cam contact surface that has curved portions used for sliding over the curved hinge to thus reduce interference when the lid is opened and closed.

12 Claims, 10 Drawing Sheets

INTERFERENCE-FREE CAM FOR HINGED-LID LIGHTERS

PRIORITY CLAIM

This application claims the benefit of U.S. Provisional Patent Application No. 60/450,270, filed on Feb. 27, 2003.

FIELD OF THE INVENTION

The present invention relates generally to lighters having curved hinges, and more specifically to a fabricated curved hinged lighter having a cam that provides for decreased interference when the lid of the lighter is opened and closed.

BACKGROUND OF THE INVENTION

The design of some reusable lighters incorporates a shell comprising an outer case and a cover or lid. A hinge connects the outer case and lid. Internal to the shell is an inside unit which is the working portion of these lighters. The inside unit can be manually removed from the outer case, loaded with fuel, and then manually reinserted into the outer case.

Such reusable lighters that have a hinge connecting the outer case and lid employ some form of a cam which is integral to the insert. The cam is used to bias against the lid and hold the lid in the closed position. However, in some lighters, the cam can obstruct the smooth opening and closing of the lid. This interference occurs because the hinges used in some lighters are curved or rounded, but the cams used in these rounded or curved hinge lighters are flat. This configuration results in the flat side of the cam contacting the curved or rounded hinge.

Subsequent movement of the flat side of the cam across the curved hinge when the lid is opened and closed can result in interference, thus making it difficult to open and close the lid. This cam to hinge interference can cause undesirable grinding noises as the metal cam digs into the curved hinge when the lid is opened and closed. Associated with the grinding noises are undesirable vibrations when the lid is opened and closed.

Another problem the interference causes arises when the insert is manually placed into the outer case during the manufacturing/assembly process of the lighter. The cam to hinge interference can delay the assembly of the lighter because the inside unit has to be adjusted to compensate for the interference.

Thus, there is a need for an improved lighter design that resolves the above described problems. There is also a need for the design to add a minimal number of parts and manufacturing steps, while at the same time not significantly increasing manufacturing costs.

SUMMARY OF THE INVENTION

The present invention meets the above-described needs by providing an interference free cam for use in a lighter comprising a shell having a hollow outer case and a hollow lid or cover attached to the outer case by a hinge. The outer case has a first sidewall disposed in spaced apart relation to a second sidewall, a first end wall disposed in spaced apart relation to a second end wall, a base connected to the first and second sidewalls and first and second end walls, and an outer case opening opposite the base. The first and second end walls are curved. The lid has a first lid sidewall disposed in a spaced apart relation to a second lid side wall, a first lid end wall disposed in a spaced apart relation to a second lid end wall, a cover wall connected to the first and second lid sidewalls and first and second lid end walls, and a lid opening opposite the cover. The first and second lid end wall are curved.

A curved hinge attaches to the outer case and lid thus connecting the outer case and the lid. The hinge comprises a hinge outer case portion attached to the second end wall of the outer case, a hinge lid portion attached to an second lid end wall, and a hinge pin. The second end wall of the outer case and the second lid end wall are aligned such that the hinge outer case-portion and hinge lid portion are aligned and fitted together, and secured together by a hinge pin.

The hinge outer case portion and hinge lid portion are curved and form a curved hinge surface. The curvature of the hinge is substantially the same as the curvature of the first and second end walls of the outer case and the curvature of the first and second lid end walls.

An inside unit is provided having a hollow housing defined by a first unit sidewall disposed in spaced apart relation from a second unit sidewall, a first unit end wall disposed in spaced apart relation to a second unit end wall, and a plate connected to the first and second unit sidewalls, respectively, and first and second unit end walls, respectively. The first and second unit end walls are curved. The inside unit has an opening opposite the plate. The first and second unit sidewalls extend above the plate and form a wind screen. A front and rear pair of lugs extend from the inside unit. The insert is receivable in the outer case.

A flint wheel is rotatably mounted between the front pair of lugs and disposed adjacent to a wick. The wick extends from a fuel reservoir defined inside the hollow housing of the inside unit. The hollow housing is filled with an absorbent material, for example cotton and/or rayon.

A movable cam is mounted to the rear pair of lugs. The cam has a cam contact surface having curved portions and a flat portion located between the curved portions. The curved portions are for engaging the curved hinge surface. Thus, when the lid is opened and closed, the cam curved portions move across the curved hinge surface. There is low interference between the cam curved portions and curved hinge surface. As a result, grinding noises and vibrations are significantly reduced. Also, manufacturing time is decreased because time does not need to be expended adjusting the inside unit in the outer case.

Additionally, the flat portion of the cam contact surface can be used in connection with hinges that are flat. In such an arrangement, the cam flat portion slides or moves over the flat hinge.

In another embodiment the cam contact surface is curved from side to side. This curvature allows for sliding contact between matching curved surfaces when the lid is opened and closed thereby decreasing interference.

BRIEF DESCRIPTION OF THE DRAWINGS

The invention is illustrated in the drawings in which like reference characters designate the same or similar parts throughout the figures of which.

DESCRIPTION OF THE INVENTION

Figure 1:
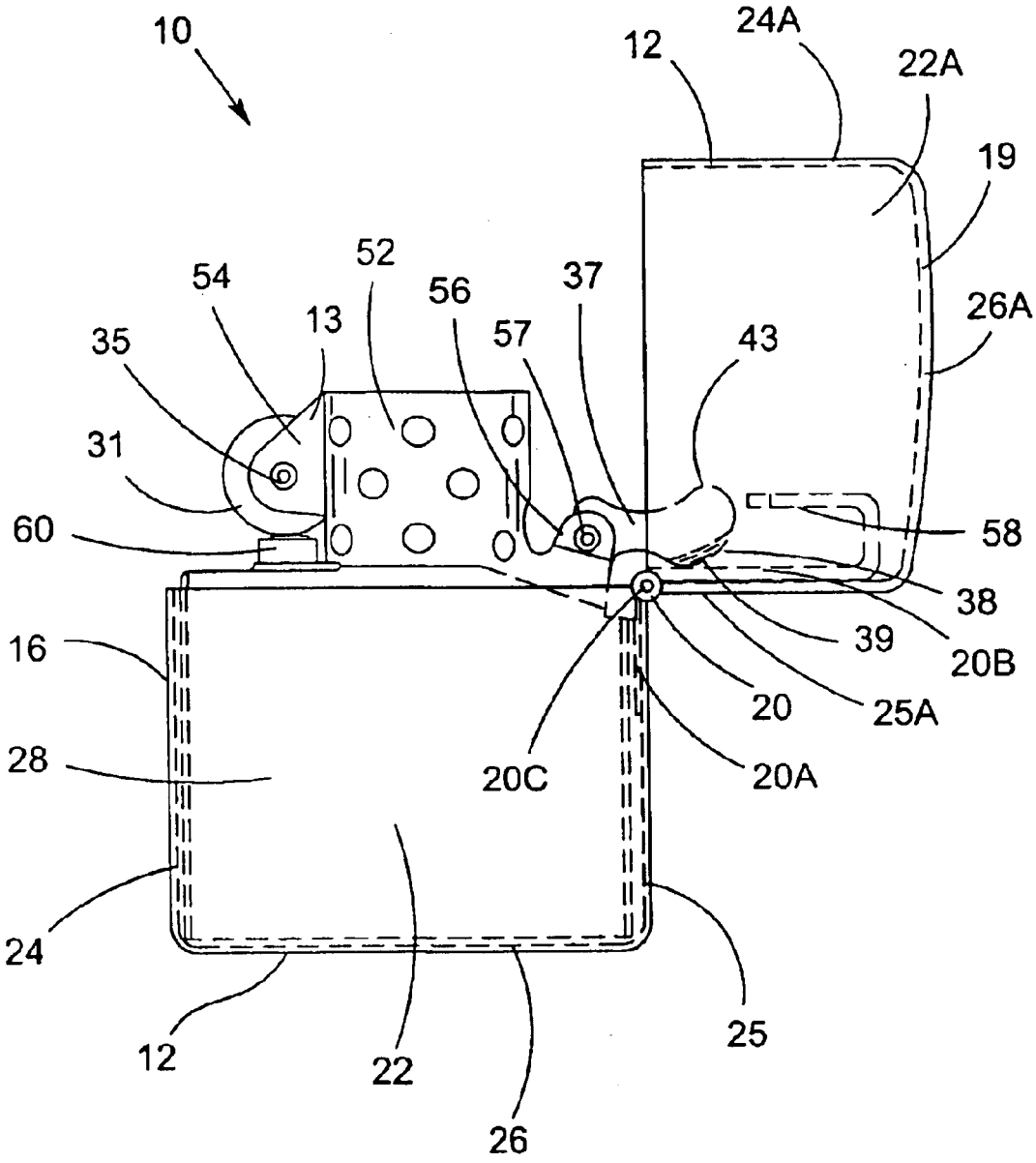
FIG. 1 is a front partly in section elevational view of the lighter with the lid in the open position.
Figure 2:
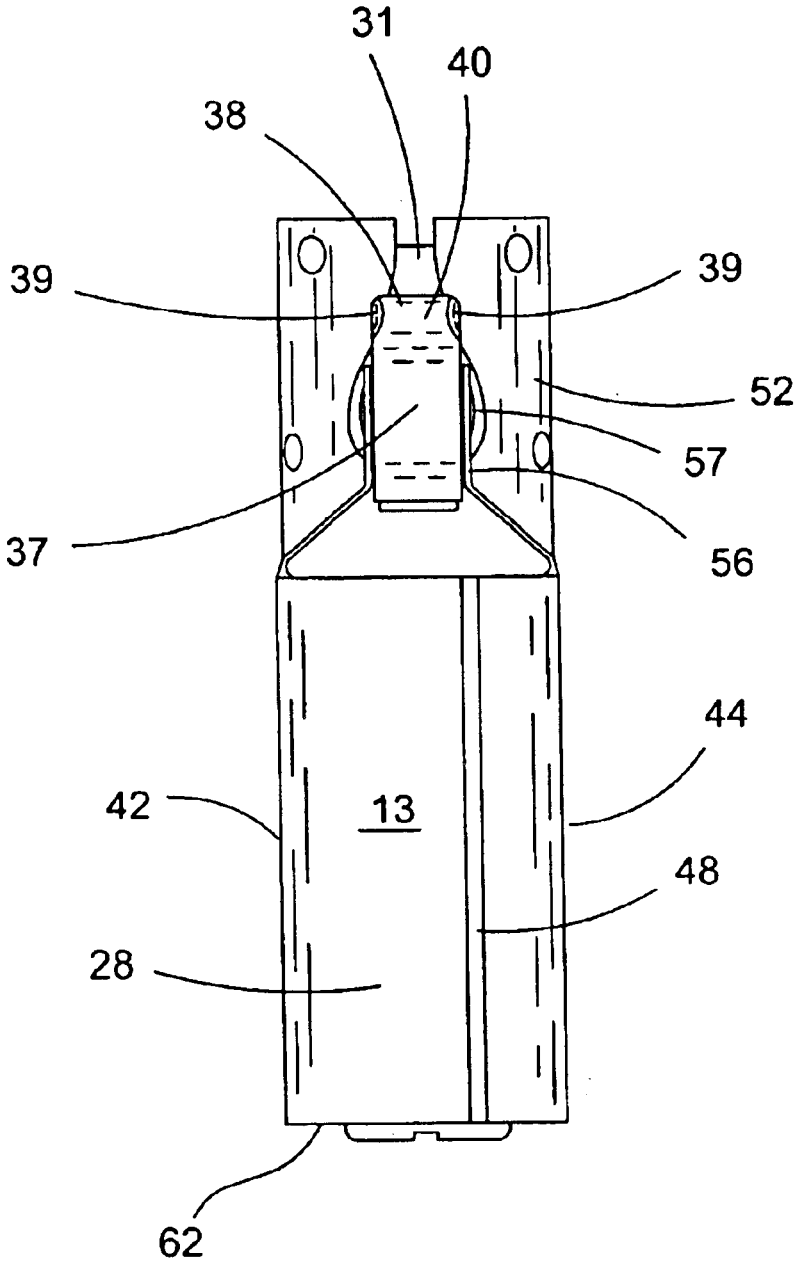
FIG. 2 is a right side elevational view of the inside unit of the lighter showing the curved portions of the cam.
Figure 3:
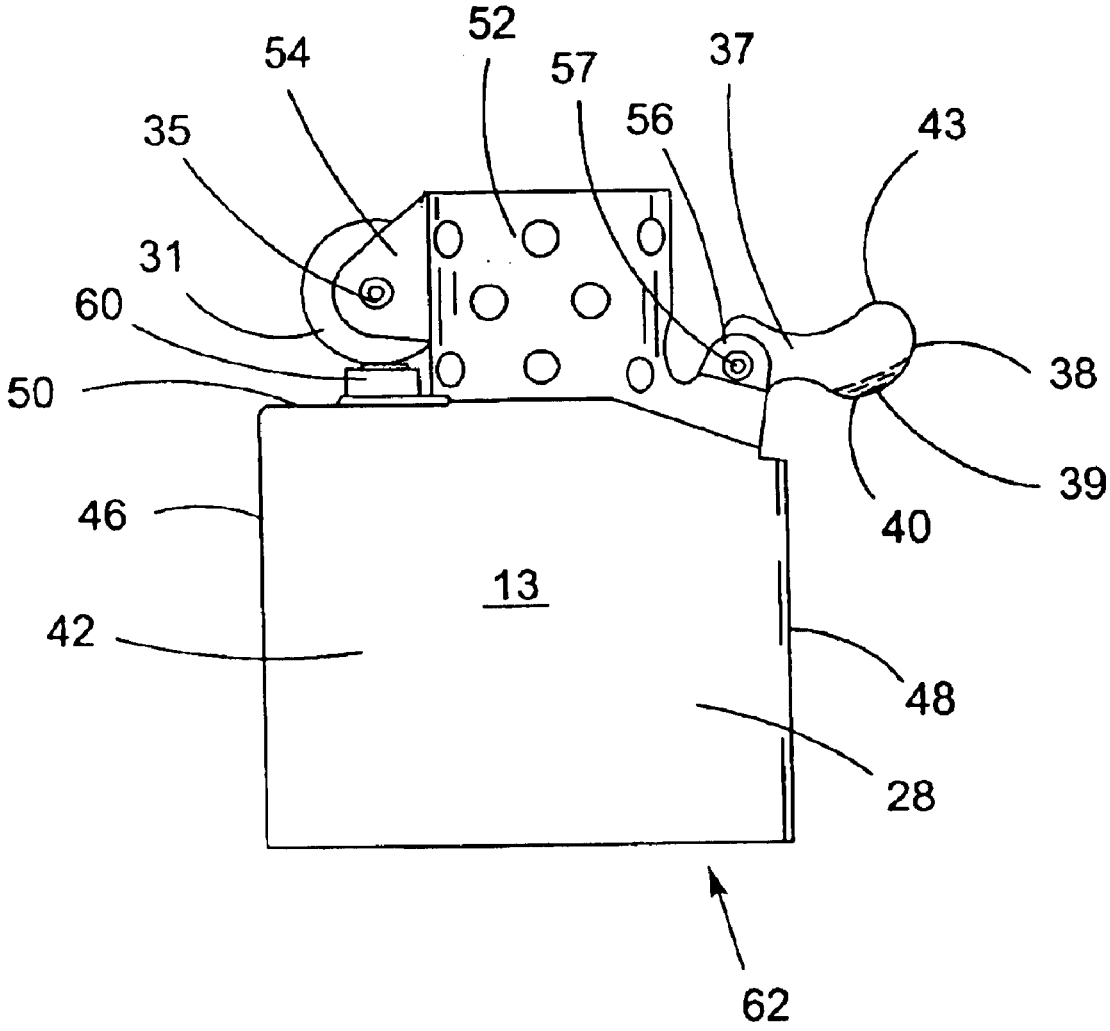
FIG. 3 is a front elevation view of the inside unit of the lighter showing the curved portion of the cam wherein the cam is in the lowered position.
Figure 4:
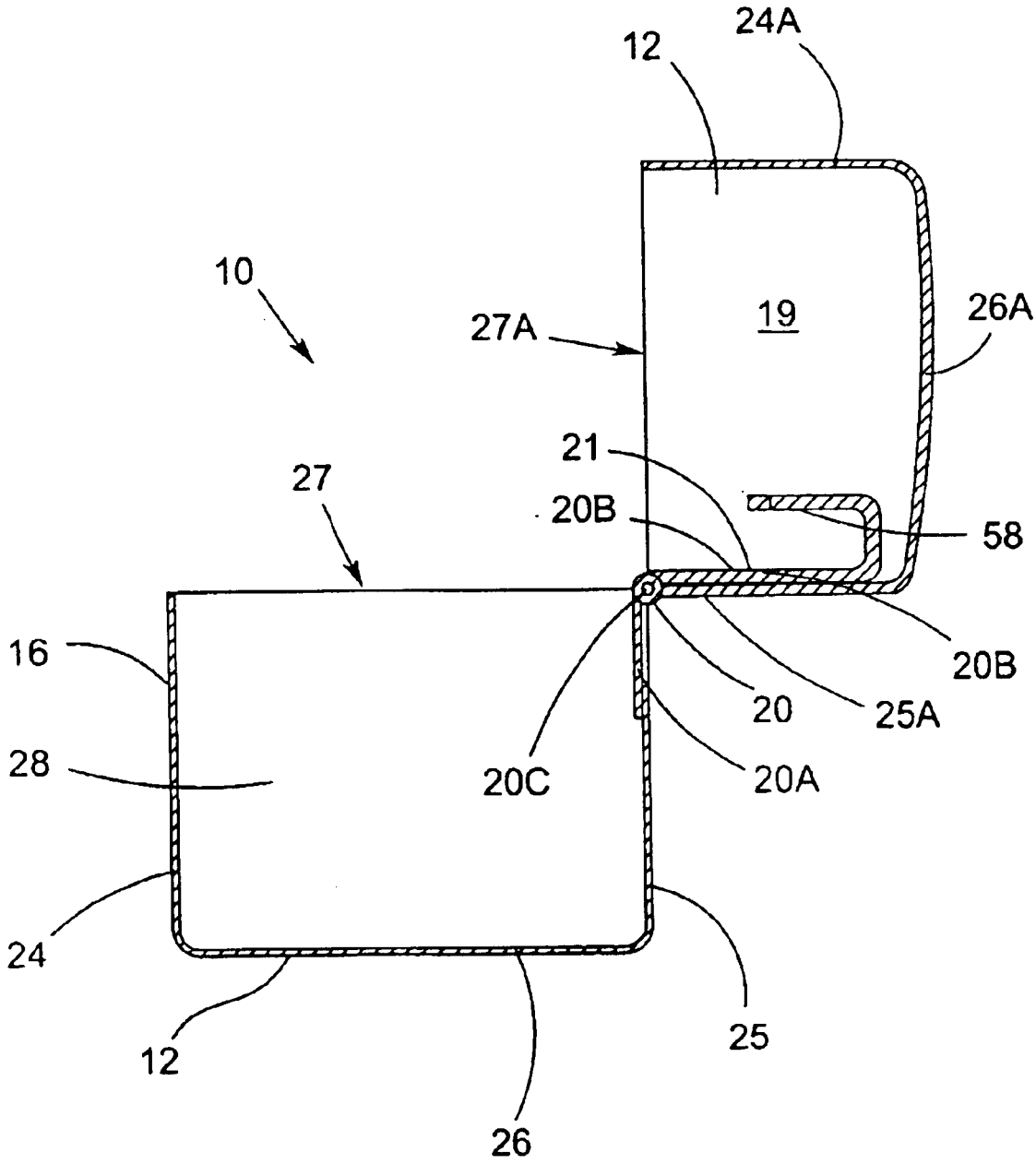
FIG. 4 is a rear elevational sectional view of the lighter shell showing the outer case, lid, curved hinge, and hinge pin.

FIGS. 1–10 show the lighter 10 of the present invention. The invention significantly reduces interference between the cam 37 and curved hinge 20 when the cover or lid 19 of the lighter 10 is opened and closed. This significant reduction in interference is attributed to the curved or rounded portions 39 of the contact surface 38 of the cam 37 that allow for sliding contact between the matching curved surface 21 of the curved hinge 20 and the curved surface of the cam 37, thus reducing interference.

Figure 5:
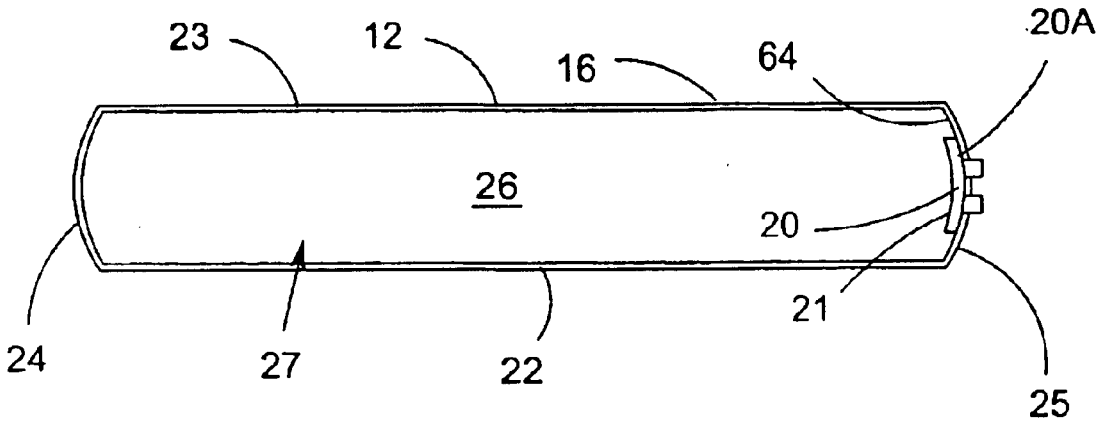
FIG. 5 is a top plan view of the outer case showing curvature of the hinge outer case portion and first outer case end wall and second outer case end wall.

As shown in FIGS. 1 and 4–8, the lighter 10 comprises a shell 12 having an outer case 16 that is hollow and a cover or lid 19 that is also hollow. A curved hinge 20 is connected to the outer case 16 and lid 19, thus connecting the outer case 16 and lid 19. As shown in FIGS. 1, 4, and 5, 6A, 7, and 8, the outer case 16 has a first side wall 22 disposed in a spaced apart relation to a second side wall 23, a first end wall 24 disposed in a spaced apart relation to a second end wall 25, and a base 26 that is connected to the first and second side walls 22, 23, respectively, and first and second end walls 24, 25, respectively. The outer case 16 has an outer case opening 27 on its side opposite the base 26 that leads to the interior of the outer case 16. The first and second end walls 24, 25, respectively, are curved as shown in FIG. 5.

Figure 6:
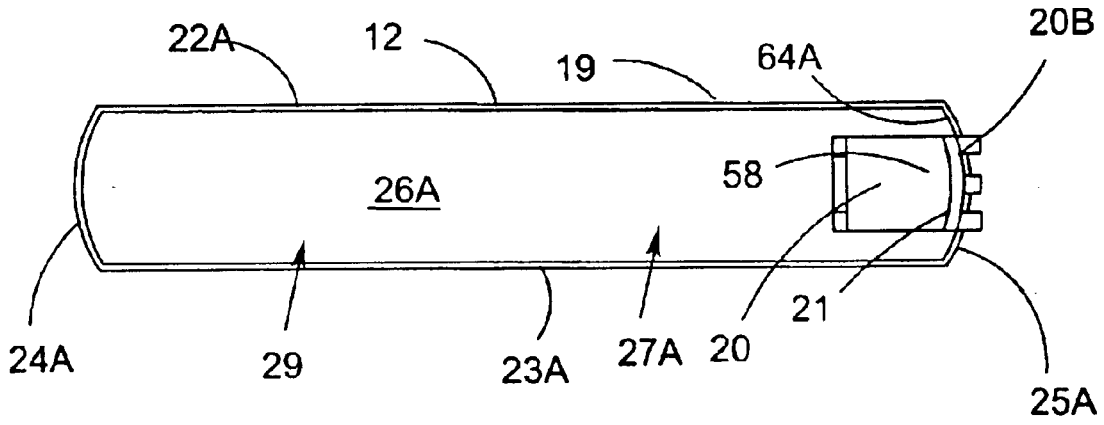
FIG. 6 is a bottom plan view of the lid showing the curvature of the hinge lid portion and the first lid end wall and second lid end wall.
Figure 6A:
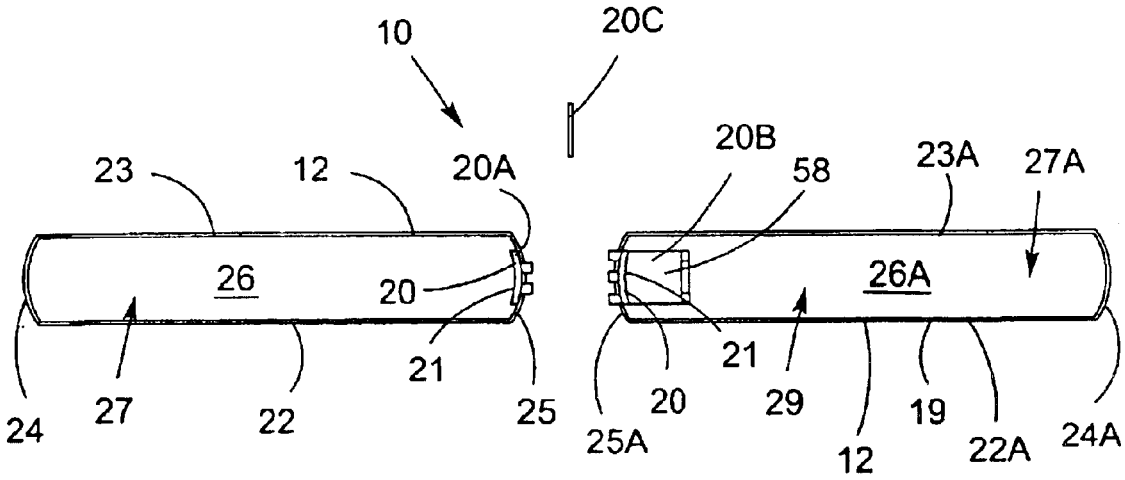
FIG. 6A is an exploded top plan view of the open lighter.
Figure 7:
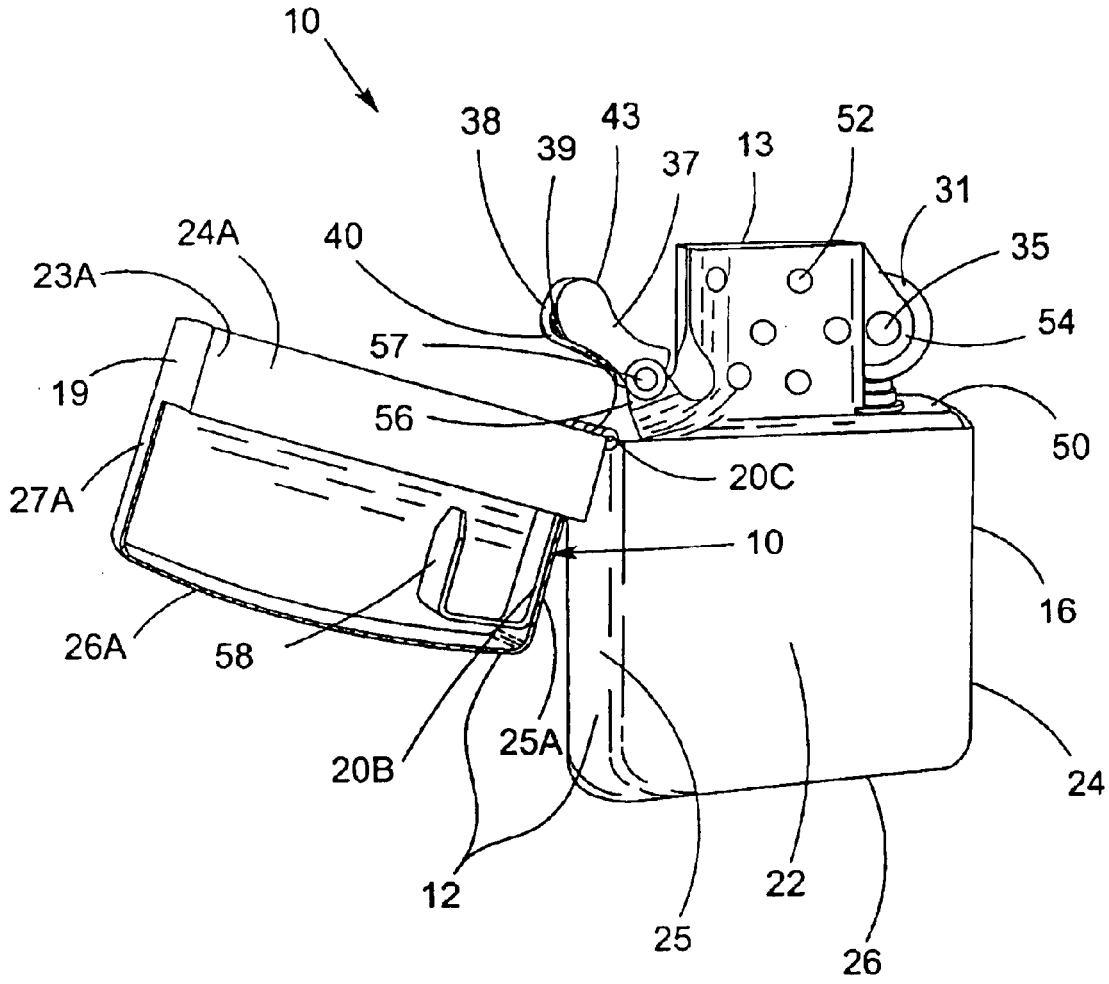
FIG. 7 is a rear perspective partly in section view of the lighter detailing the curved hinge and curved portions of the cam.
Figure 8:
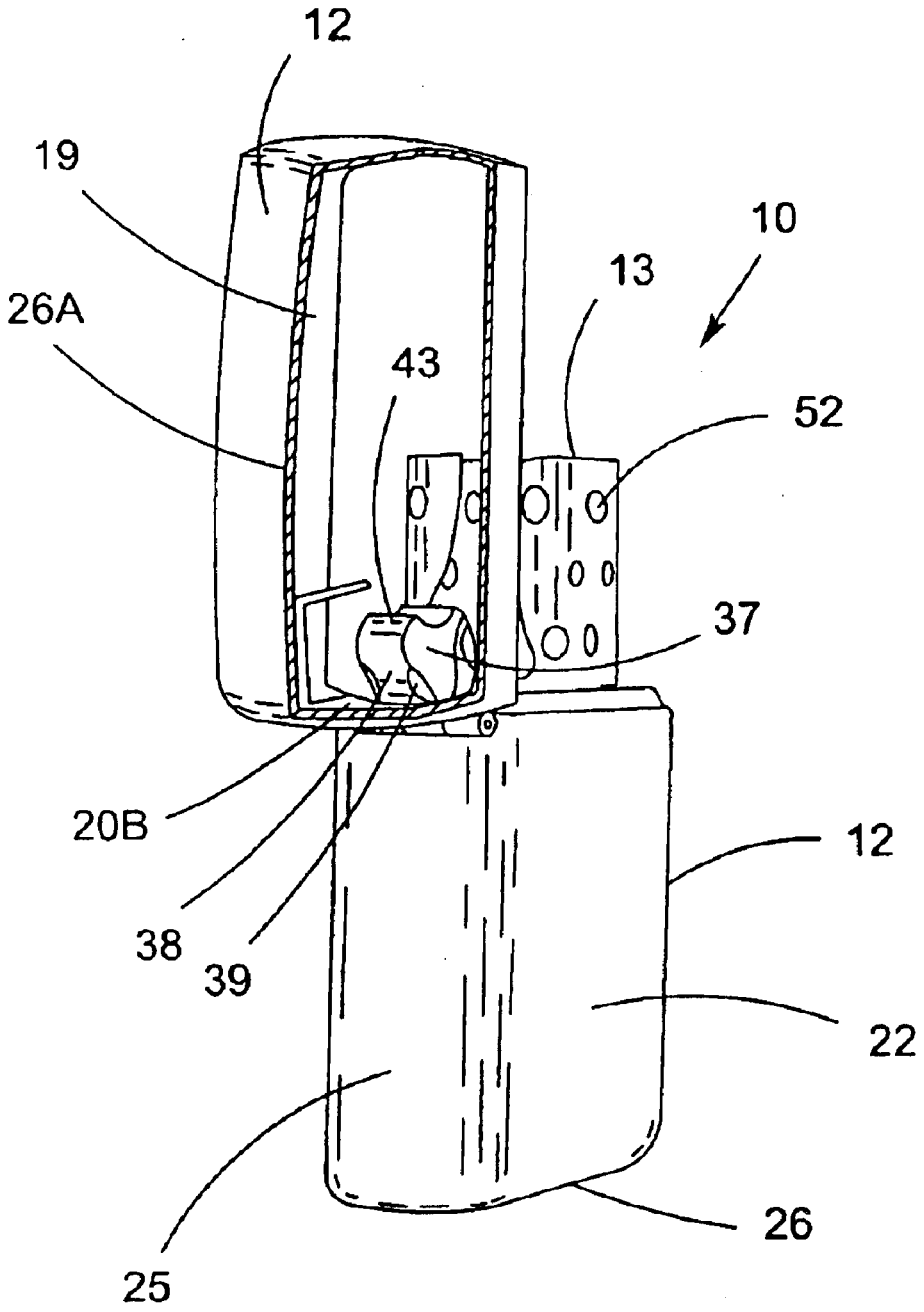
FIG. 8 is a rear perspective partly in section view of the lighter showing the curved portions of the cam contacting the curved hinge.

The lid 19, shown in FIGS. 1, 4, and 6–8, has a first lid sidewall 22A disposed in a spaced apart relation to a second lid sidewall 23A, a first lid end wall 24A disposed in a spaced apart relation to a second lid end wall 25A, and a cover wall 26A. The cover wall 26A is connected to the first and second lid side walls 22A, 23A, respectively, and the first and second lid end walls 24A and 25A, respectively. The lid 19 has a lid opening 27A opposite the cover wall 26A which leads to the lid recess 29. The first and second lid end walls, 24A, 25A, respectively, are curved, as shown in FIG. 6. When the lid 19 is closed it aligns with the outer case 16 because the curvature of the first and second end walls 24, 25, respectively, and first and second lid end walls 24A, 25A, respectively, is substantially the same.

The curved hinge 20 pivotally connects the outer case 16 and lid 19 and is shown in FIGS. 1, 4, and 5–8. As shown, the curved hinge 20 comprises a curved hinge outer case portion 20A connected to the end second wall 25 of the outer case 16. The curved hinge 20 also comprises a curved hinge lid portion 20B connected to the second lid end wall 25A. It is noted that the curved hinge outer case portion 20A and curved hinge lid portion 20B are connected to the insides 64, 64A, respectively, of the second end wall 25 and lid end wall 25A, as shown in FIGS. 5 and 6. A hinge pin 20C is inserted and secured between the hinge outer case portion 20A and hinge lid portion 20B to thus hold the curved hinge 20 together. Also, the curved hinge outer case portion 20A and curved hinge lid portion 20B and the first and second end walls 24, 25, respectively, and first and second lid end walls 24A, 25A, respectively, have a curvature that is substantially the same. Additionally, the curved hinge outer case portion 20A and curved hinge lid portion 20B each have a curved hinge surface 21 as shown in FIGS. 5–8. Extending from the curved hinge cover portion 20B and into the recess 29 defined by the lid 19 is a hinge cross member 58.

Figure 9:
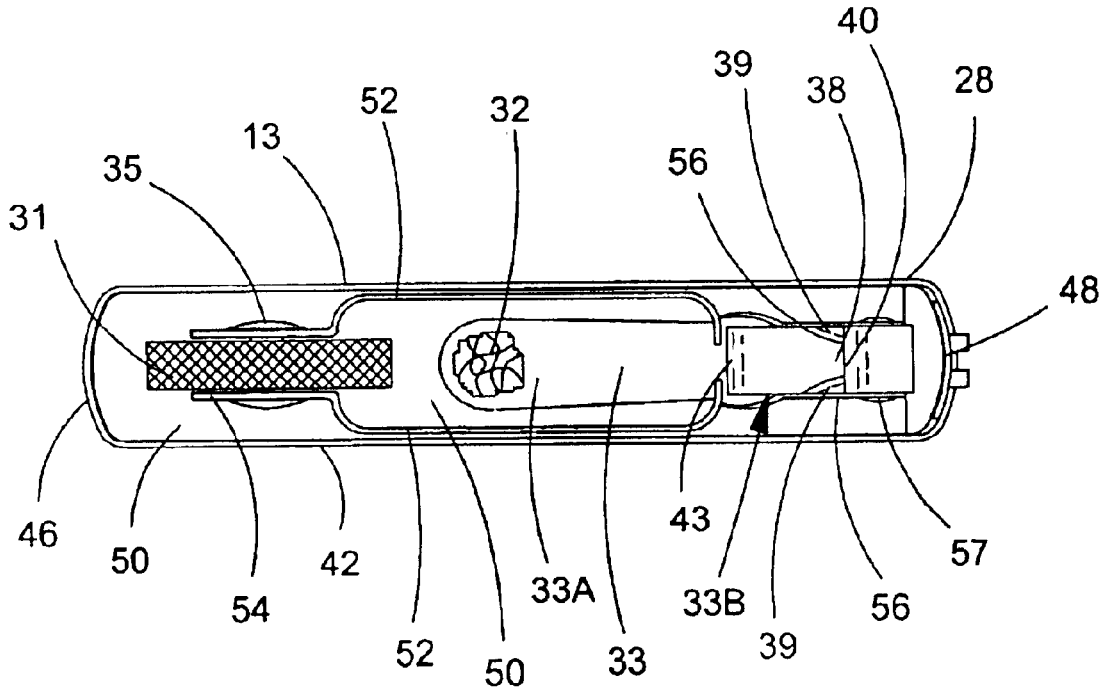
FIG. 9 is a top plan view of the inside body unit wherein the cam is in the raised position.
Figure 10:
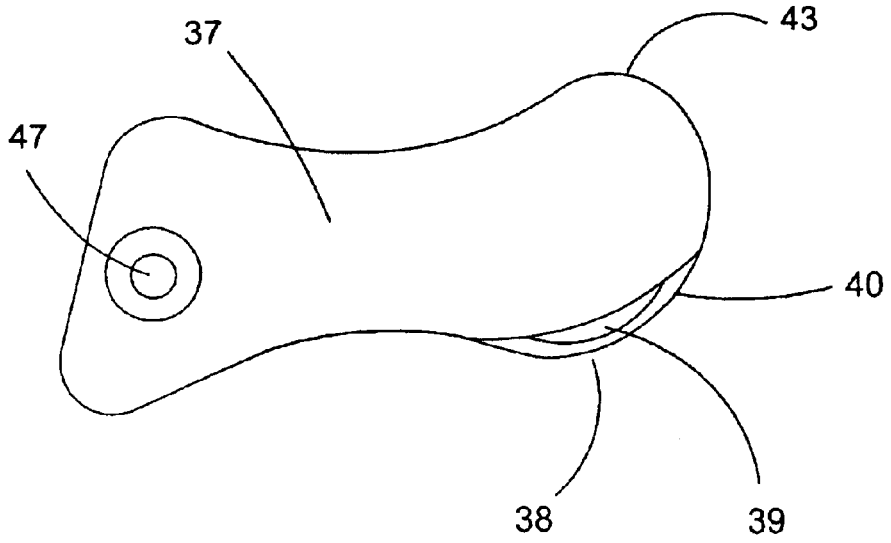
FIG. 10 is a front elevational view of the cam showing the curved or rounded portions of the cam contact surface along with a flat contact portion.
Figure 10A:
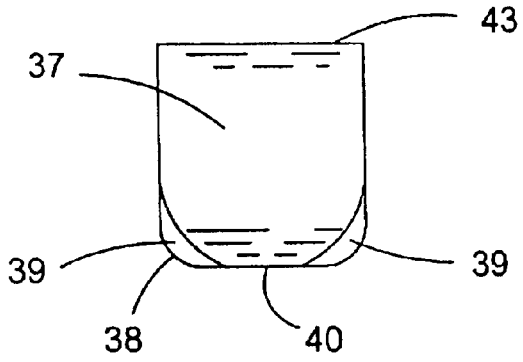
FIG. 10A is a right side elevational view of the cam showing the curved portions and flat portion.

The inside body unit 13 (hereinafter inside unit 13), shown in FIGS. 1–3 and 9, is sized so that it can be manually slid in and out of the outer case 16 and held therein by a friction fit. The inside unit 13, outer case 16, and lid 19 are all hollow and can be formed out of sheet metal. In particular, the inside body unit 13 is formed as a sheet metal casing 28 having and having a first casing side wall 42 disposed in spaced apart relation from a second casing side wall 44, a first casing end wall 46 disposed in spaced apart relation from a second casing end wall 48, and a plate 50 connected to the first and second casing side walls 42, 44, respectively, and first and second casing end walls 46, 48, respectively. There is an opening 62 in the casing 28 opposite the plate 50. The first and second casing side walls 42, 44, respectively, extend above the plate 50 and are formed to provide a wind screen 52 so that the lighter will not be extinguished by wind. The first and second casing side walls 42, 44, respectively, are also formed to provide a front pair of lugs 54 and a rear pair of lugs 56. As shown in FIG. 9, the inside unit 13 is provided with a wick 32 that extends downwardly in a central location to the lower end of the inside unit 13. The hollow inside unit 13 is loaded with a filling of suitable absorbent material (not shown), which may be cotton and/or rayon or other suitable materials or blends and/or combinations thereof, that surrounds the wick 32, thus filling the space within the metal casing 28. The absorbent material serves to store fuel used in the lighter 10. The inside unit 13 also has a flint wheel 31 mounted on a flint wheel pin 35 supported by the front pair of lugs 54. The flint wheel 31 is disposed adjacent to the flint 60. The flint 60 can be spring biased into the flint wheel 31 by a spring (not shown) disposed internal to the inside unit 13. The flint wheel 31 is also disposed adjacent to the wick 32 extending from a fuel reservoir defined inside the metal casing 28. To generate a spark the flint wheel 31 is spun (manually), thus showering the wick 32 with sparks causing it to ignite.

The inside unit body 13 is disposed inside the outer case 16 by means of a friction fit. The friction fit has to be snug enough so that the inside unit 13 does not move inside the outer case 16, yet is loose enough such that it can be removed for refilling. In order to refill the lighter 10, the inside unit 13 is removed and lighter fuel is added through the opening 62 in the inside unit 13. A resilient barrier (not shown) covering the absorbent cotton material is removed manually, and the lighter fuel is added to the absorbent cotton material until a charge of fluid fuel has been delivered. Next, the inside unit 13 is frictionally fit back into the outer case 16. Casing 28 of the inside unit 13 slides into engagement with the base 26 of the outer case 16 to thus form a fuel storage area that is sealed against leaking by the snug fit. The fit between the inside unit 13 and the outer case 16 is such that the inside unit 13 can be easily extracted and reinserted by hand, without the use of tools. The inside unit 13, when received in the outer case 16, does not move about the inside of the outer case 16 under normal operation of the lighter 10.

A cam 37, as shown in FIGS. 1–3, 7–10A, is provided and is integral to the inside unit 13. The cam 37 has a recess 47 (FIG. 10) and is mounted to the rear pair of lugs 56 by a cam pin 57 inserted into the recess 47. A spring 33 is provided having an attachment end 33A that is connected to the plate 50 in the vicinity of the wick 32, as shown in FIG. 9. The free end 33B of the spring 33 biases against the cam 37. As shown, the spring 33 may be a leaf-type spring. The other end of the spring 33, that being the free end 33B of the spring, is thus disposed between the cam 37 and the plate 50 and forces or urges against the cam 37. The spring 33 also applies force for biasing the cam 37 against the cross member 58 when the lid 19 is closed in order to keep the lid 19 closed.

The cam 37 has a contact surface 38, shown in FIGS. 1–3, 7,8, 10–10A that slides across the curved hinge surface 21 of curved hinge lid portion 20B when the lid 19 is opened and closed. The cam 37 contact surface 38 is provided with curved or rounded portions 39 and a flat portion 40 that is disposed between the curved portions 39 as shown in FIGS. 1–3, 7, 8–10A. When the lighter 10 lid 19 is opened and closed the curved or rounded portions 39 of the cam 37 contact surface 38 slide over the curved hinge surface 21 of the curved hinge lid portion 20B, thus reducing interference between the cam 37 contact surface 38 and curved hinge surface 21. The curved or rounded portion 39 of the cam 37 also significantly reduces grinding noises and vibrations when the lid 19 is opened and closed.

By way of illustration, when the lid 19 shown in FIG. 1 is closed, the cam 37 rotates counterclockwise. As this occurs the rounded portions 39 of the cam 37 slide over the curved hinge surface 21 and curved hinge lid portion 20B with a low amount of interference. Then, as the counter-clockwise rotation continues, the cam 37 rotates past the dead center position of the pivot 56 and the lid 19 of the lighter 10 closes. The cam 37 also has a lid shutting surface 43, and the spring 33 biases the lid shutting surface 43 against the cross member 58 to keep the lid 19 of the lighter 10 closed.

The flat portion 40 of the cam contact surface 38 is for use with flat hinges (not shown). If the hinge is flat and not curved, then the flat portion 40 of the cam 37 would slide over the flat hinge contact surface of the flat hinge. Thus, the cam 37 is suitable for use in both flat hinged lighters and lighters 10 having curved hinges 20.

Figure 11:
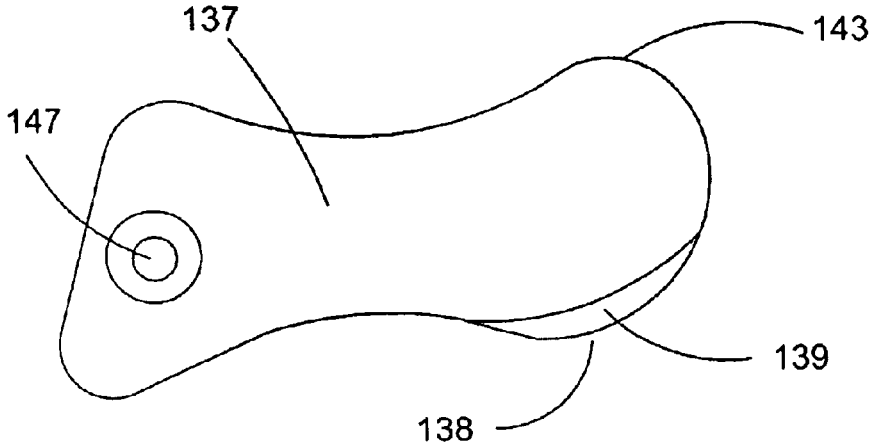
FIG. 11 is a front elevational view of another embodiment of the cam wherein the cam contact surface is completely rounded or curved.

In another embodiment shown in FIG. 11, the lighter may have a curved hinge surface 21 as described above. The cam 137 may have a cam contact surface 138 that is curved or rounded from one side to the other side such that the entire cam contact surface 138 is curved and there is no flat portion. As shown, the cam 137 may be mounted in the manner previously described. In such an embodiment the likelihood of an interference between the cam 137 and lid 19 is decreased, as there would only be the curved cam contact surface 138 engaging and sliding over the curved surface 21 of the curved hinge 20.

It will be appreciated by those skilled in the art that while the invention has been described above in connection with particular embodiments and examples, the invention is not necessarily so limited and other embodiments, examples, uses, and modifications and departures from the embodiments, examples, and uses may be made without departing from the invention. All of these alternative embodiments are intended to be within the scope and spirit of the this invention.

What is claimed:

1. A lighter comprising:

a) an outer case having a first sidewall disposed in spaced apart relation to a second sidewall, a first end wall disposed in spaced apart relation to a second end wall and a base connected to the first sidewall, second sidewall, first end wall, and second end wall, and an outer case opening opposite the base, b) a lid comprising a cover wall connected to a first lid sidewall disposed in a spaced apart relation to a second lid sidewall, and a first lid end wall disposed in a spaced apart relation to a second lid end wall, and a lid opening opposite the cover wall, c) a curved hinge comprising a curved hinge outer case portion connected to the second end wall of the outer case and a curved hinge lid portion connected to the second lid end wall and a pin used for holding the curved hinge out case portion and curved hinge lid portion together, d) an inside unit disposed in the outer case, the inside unit comprising a plate connected to a first casing sidewall disposed in spaced apart relation from a second casing side wall a first casing end wall disposed in spaced apart relation to a second casing end wall the first casing sidewall and second casing sidewall extend above the plate and form a front pair of lugs and a rear pair of lugs, e) a flint wheel mounted between the front pair of lugs and disposed adjacent to the flint wheel a wick extending from a fuel reservoir defined inside the inside unit and a flint in contact with the flint wheel and used for generating sparks when rotated to ignite the wick, and f) a cam mounted to the rear pair of lugs and having a cam contact surface having curved portions the curved portions are used for sliding over the curved hinge lid portion when the lid is opened and closed so that interference between the curved hinge lid portion and the cam is reduced.

2. The lighter according to claim 1 wherein the cam contact surface further comprises a flat portion disposed between the curved portions of the cam contact surface.

3. The lighter according to claim 1 wherein the curved portions of the cam contact surface extend completely across the cam for preventing interference between the cam and the curved hinge surface when the lid is opened and closed.

4. The lighter according to claim 1 wherein the first end wall of the outer case, second end wall of the outer case, first lid end wall, and second lid end wall are curved.

5. The lighter according to claim 4 wherein a the curvature of each of the first end wall of the outer case, second end wall of the outer case, first lid end wall, and second lid end wall is the same.

6. An inside unit for use in a lighter having a curved hinge, the inside unit comprising:

a) a plate connected to a first casing sidewall disposed in spaced apart relation from a second casing side wall, a first casing end wall disposed in spaced apart relation to a second casing end wall, the first casing sidewall and second casing sidewall extend above the plate and being formed to provide a front pair of lugs and a rear pair of lugs, b) a flint wheel mounted between the front pair of lugs and disposed adjacent to the flint wheel a wick extending from a fuel reservoir defined inside the inside unit and a flint in contact with the flint wheel and used for generating sparks when rotated to ignite the wick, and c) a cam mounted to the rear pair of lugs and having a cam contact surface having curved portions with a flat portion disposed between the curved portions, the curved portions used for engaging the curved hinge when the lid is opened and closed so that interference between the curved hinge lid portion and the cam is reduced.

7. An inside unit for use in a lighter having a curved hinge, the inside unit comprising:

a) a plate connected to a first casing sidewall disposed in spaced apart relation from a second casing side wall, a first casing end wall disposed in spaced apart relation to a second casing end wall, the first casing sidewall and second casing sidewall extend above the plate and being formed to provide a front pair of lugs and a rear pair of lugs, b) a flint wheel mounted between the front pair of lugs and disposed adjacent to the flint wheel a wick extending from a fuel reservoir defined inside the inside unit and a flint in contact with the flint wheel and used for generating sparks when rotated to ignite the wick, and c) a cam mounted to the rear pair of lugs and having a cam contact surface having curved portion extending across the entire cam contact surface and used for engaging the curved hinge when the lid is opened and closed so that interference between the curved hinge is reduced.

8. A method of manufacturing a lighter comprising the steps of:

a) providing an outer case having a first sidewall disposed in spaced apart relation to a second sidewall, a first end wall disposed in spaced apart relation to a second end wall, and a base connected to the first sidewall, second sidewall, first end wall, and second end wall, and providing a case opening opposite the base, b) providing a lid comprising a cover wall connected to a first lid sidewall disposed in a spaced apart relation to a second lid sidewall, and a first lid end wall disposed in a spaced apart relation to a second lid end wall, and providing a lid opening opposite the cover wall, c) providing a curved hinge comprising a curved hinge outer case portion and connecting the curved hinge outer case portion to the second end wall of the outer case and providing a curved hinge lid portion and connecting the curved hinge lid portion to the second lid end wall and providing a pin for connecting the curved hinge outer case portion and curved hinge lid portion, d) providing an inside unit comprising a plate connected to a first casing sidewall disposed in spaced apart relation from a second casing side wall, a first casing end wall disposed in spaced apart relation to a second casing end wall, the first casing sidewall and second casing sidewall extend above the plate and forming a front pair of lugs and a rear pair of lugs, e) mounting a flint wheel between the front pair of lugs and disposing adjacent to the flint wheel a wick extending from a fuel reservoir defined inside the inside unit with the inside unit received in the outer case and used for generating a spark, and f) mounting a cam between the rear pair of lugs and providing the cam with a cam contact surface having curved portions for sliding over the curved hinge lid portion when the lid is opened and closed so that interference between the curved hinge lid portion and the cam is reduced.

9. The method of manufacturing a lighter according to claim 8 further comprising the steps of providing the cam contact surface with a flat portion disposed between the curved portions.

10. The method of manufacturing a lighter according to claim 8 further comprising the steps of providing the curved portions of the cam contact surface completely across the cam for preventing interference between the cam and the curved hinge surface when the cover is opened and closed.

11. A method of manufacturing an inside unit for a lighter having a lid and curved hinge comprising the steps of:

a) providing a plate and connecting the plate to a first casing sidewall disposed in spaced apart relation from a second casing side wall, a first casing end wall disposed in spaced apart relation to a second casing end wall, and forming the first casing sidewall and second casing sidewall to extend above the plate and forming a front pair of lugs and a rear pair of lugs from the first casing sidewall and second casing sidewall, b) mounting a flint wheel between the front pair of lugs and disposing adjacent to the flint wheel a wick extending from a fuel reservoir defined inside the inside unit with the inside unit received in the outer case and used for generating a spark, and c) mounting a cam on the rear pair of lugs and providing the cam with a cam contact surface having curved portions with a flat portion disposed between the curved portions, the curved portions for used for sliding over the curved hinge when the lid is opened and closed so that interference between the curved hinge and the cam is reduced.

12. A method of manufacturing an inside unit for a lighter having a lid and curved hinge comprising the steps of:

a) providing a plate and connecting the plate to a first casing sidewall disposed in spaced apart relation from a second casing side wall, a first casing end wall disposed in spaced apart relation to a second casing end wall, and forming the first casing sidewall and second casing sidewall to extend above the plate and forming a front pair of lugs and a rear pair of lugs from the first casing sidewall and second casing sidewall, b) mounting a flint wheel between the front pair of lugs and disposing adjacent to the flint wheel a wick extending from a fuel reservoir defined inside the inside unit with the inside unit received in the outer case and used for generating a spark, and c) mounting a cam on the rear pair of lugs and providing the cam with a cam contact surface having a curved portion extending completely across the cam contact surface, the curved portion of the cam used for sliding over the curved hinge when the lid is opened and closed so that interference between the curved hinge and the cam is reduced.

* * * * *